United States Patent [19]

Oefinger

[11] Patent Number: 4,598,571

[45] **Date of Patent: * Jul. 8, 1986**

[54] CONTROL VALVE FOR A MANDREL COLLECTION SYSTEM

[75] Inventor: Richard W. Oefinger, Shelton, Conn.

[73] Assignee: USM Corporation, Farmington, Conn.

[ * ] Notice: The portion of the term of this patent subsequent to May 21, 2002 has been disclaimed.

[21] Appl. No.: 595,731

[22] Filed: Apr. 2, 1984

[51] Int. Cl.[4] ..... B21D 9/05

[52] U.S. Cl. ..... 72/391; 72/453.17

[58] Field of Search ..... 72/391, 453.17, 453.19; 29/243.53

[56] References Cited

U.S. PATENT DOCUMENTS

| | | | |
|---|---|---|---|
| 3,523,441 | 8/1970 | Bell et al. | 72/453.17 |
| 4,281,531 | 8/1981 | Ehmann et al. | 72/453.17 |
| 4,517,820 | 5/1985 | Oefinger et al. | 72/391 |

*Primary Examiner*—Francis S. Husar
*Assistant Examiner*—David B. Jones
*Attorney, Agent, or Firm*—Alan N. McCartney

[57] ABSTRACT

A heavy duty power operated blind rivet setting tool having a mandrel collection system for drawing the pulled mandrel through the tool to a collection canister at the rear of the tool. The tool is operated by a primary air supply and the mandrel collection system is operated by a secondary air supply located within the physical confines of the tool. A control valve is located in the secondary air line which can render the mandrel collection system inoperative.

4 Claims, 3 Drawing Figures

CONTROL VALVE FOR A MANDREL COLLECTION SYSTEM

BACKGROUND OF THE INVENTION

1. Field of the Invention

This invention relates to heavy duty power operated blind rivet tools which have a system for collecting the pulled (spent) mandrel of the rivet. More specifically, the invention relates to a control valve for such a mandrel collection system.

2. Summary of the Prior Art

Power operated blind rivet application tools are for heavy duty continuous assembly line operation, and examples of such tools are illustrated in U.S. patent application No. 3,088,618 and 3,254,522.

In the use of such tools, it is desirable to provide a means to quickly and efficiently remove the spent mandrel from the rivet mandrel removing jaw area of the tool. Otherwise, the spent mandrel would have to be removed through the nose of the tool which would prevent quickly inserting into the tool nose another rivet - mandrel assembly for application of the rivet to the workpiece.

Therefore, provision has been made for providing a canister on the rear of the tool and by placing a vacuum in the canister, the spent mandrel is drawn through the tool into the canister. An example of tools with mandrel collection systems of this type are illustrated in U.S. Pat. Nos. 3,415,102 and 4,281,531.

One manner of providing a vacuum in the canister is by supplying air pressure to a transducer coacting with the canister which creates a vacuum in the canister to draw the spent mandrel through the tool. In commonly owned U.S. patent application Ser. No. 506,659 filed June 22, 1983 there is illustrated a mandrel collection system of this latter type.

In some tools, it is desirable to eliminate the function of the mandrel collection system when removing the canister and thus it becomes necessary to render the air line to the collection system inoperative. Otherwise, the spent mandrel would be freely ejected from the rear of the tool with above normal ejection velocity creating a discomfort to the operator. Further, air can be conserved by shutting off the mandrel collection system during break periods.

Heretofore, it has been unknown in this art to provide the air line to a mandrel collection system with a control valve to render the system inoperative with the control valve being located within the physical confines of the tool.

BRIEF SUMMARY OF THE INVENTION

It is an object of this invention to provide a mandrel collection system for a blind rivet tool, with the system having a canister at the rear of the tool which is subjected to a vacuum by a pressurized air line passing air through a transducer in communication with the canister. The vacuum in the canister draws the pulled mandrel through the tool into the canister. A primary air line to power the tool passes into a recessed area of the bottom of the tool. A control valve is positioned in a secondary air line passing from the primary air line up through the enclosure of the tool to the transducer. The control valve is positioned in the recessed tool bottom and can render the secondary air line inoperative and thus the mandrel collection system non-functional. This entire arrangement places the mandrel collection control within the confines of the tool so that the tool can stand upright on a support surface and places the secondary air line free from any interference of the operator.

DESCRIPTION OF THE PREFERRED EMBODIMENT

In commonly owned U.S. patent application Ser. No. 506,659 filed June 22, 1983 there is disclosed a power operated blind rivet tool having a mandrel collection system for drawing a spent mandrel through the tool into a collection canister at the rear of the tool. The disclosure in that patent application is incorporated herein by reference.

Figure 1:
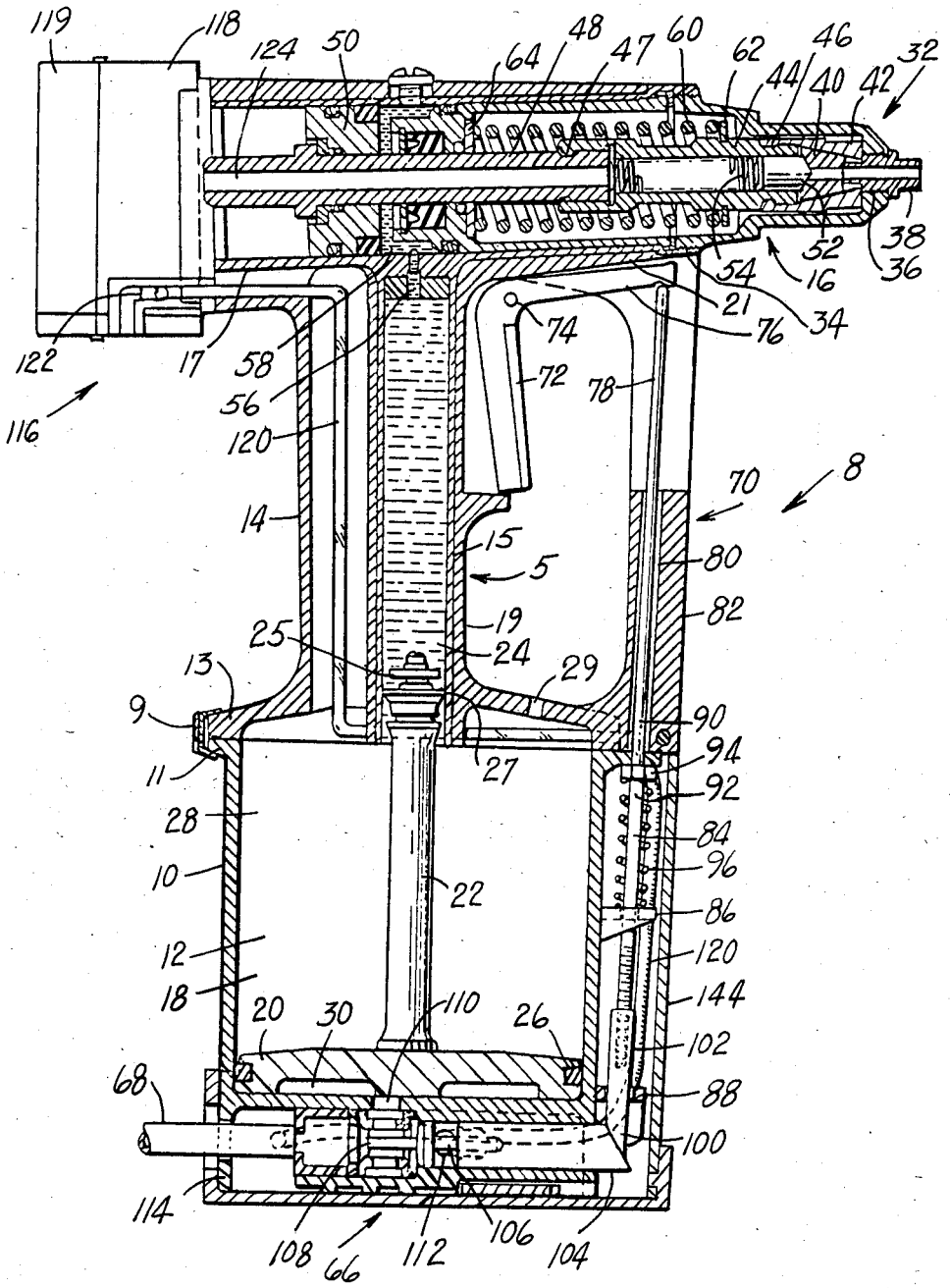
FIG. 1 is a side elevational view, partially in section, of a power operated blind rivet tool having a mandrel collection system.

Attention is now directed to FIG. 1 which illustrates the blind rivet setting tool 8 of this invention as having a one piece lower housing 10 containing the pressure vessel 12 and a one piece upper housing 14 containing the rivet setting mechanism 16. The housings 10 and 14 have mating flanges 11 and 13 secured together by a band 9. The upper housing 14 has a metal sleeve 15 in the tool handle area 5 and a metal sleeve 17 in the rivet setting mechanism 16. The sleeves 15 and 17 are surrounded by a glass filled nylon 19 and 21 which lends sufficient rigidity to the upper housing while enable the tool to be of light weight construction.

The pressure vessel 12 is cylindrical and has an opening 18 receiving a piston 20. The piston 20 has a piston rod 22 carried in the central open cylindrical area 24 of the upper housing 14. The piston 20 has an annular sealing ring 26 sealing the upper area 28 of the vessel from the lower area 30 of the vessel. The open area 24 in the tool handle 32 contains hydraulic fluid. The end 25 of the rod 22 has a seal 27. The lower area 30 of the vessel 12 is adapted to be subjected to compressed air to move the piston 20 upwardly and compress the hydraulic fluid to operate the rivet setting mechanism 16 as will become apparent hereinafter. At the same time, the air located in the upper area 28 is exhausted through ports 29.

The rivet setting mechanism 16 comprises a mandrel pulling mechanism 32 threaded into the sleeve 17 at 34. Threaded into the opening 36 of the mechanism 32 is a nosepiece 38 which receives the rivet mandrel as is well-known in the art. A pair of jaws 40 are adapted to grip the rivet mandrel. Surrounding the jaws 40 is a jaw guide 42 attached to a draw bar 44 by mating threads 46. The drawbar 44 is attached at 47 to a piston rod 48 which has a piston 50 in the sleeve 17. A jaw pusher 52 is biased by spring 54 against the jaws 40 to keep the jaws 40 in an open condition when pressed against the nosepiece 38.

In the operation of the rivet setting mechanism 16, as the hydraulic fluid in the open area 24 is transferred by upward movement of piston 20, the fluid passes through opening 56 increasing in volume in area 58 in front of piston 50 causing the piston 50 to move to the left in FIG. 1. The initial movement of the piston 50 moves the piston rod 48, the draw bar 44 and the jaw guide 42 to force the jaws 40 against the rivet mandrel. Further, movement of the piston 50 will draw the mandrel through the rivet body, as is well-known in the art. A spring 60 is carried between the restrained washer 62 on the draw bar 44 and the rear of cylinder 64 surround the piston rod 48. The spring 60 returns the rivet setting mechanism after the mandrel pulling operation.

The air pressure to the area 30 of vessel 12 is supplied through a control valve 66 communicating with a primary air supply line 68. The valve 66 is activated by a trigger mechanism 70. A trigger 72 is pivoted at 74 to the upper housing handle area 5. The trigger 72 is actuated by the fingers of the operator and the opposed leg 76 of the trigger 72 engages the upper trigger rod 78 slideably disposed in the opening 80 of the upper trigger rod housing 82. A lower trigger rod 84 is carried on brackets 86, 88 attached to the front of the pressure vessel 12. The lower end 90 of the upper trigger rod 78 contacts the upper end 92 of the lower trigger rod 84. A hex head 94 is carried on the upper end 92 of the lower trigger rod 84 and a spring 96 acts between the bracket 86 and the hex head 94 to bias the trigger rods 78, 84 upwardly. A shoe 100 is threaded onto the lower end 102 of the lower trigger rod 84.

The shoe 100 has a sloped face coacting with the sloped face on a plunger 104 connected by a projection 106 to the valve 108. In operation, pulling the trigger 72 will force the trigger rods 78, 84 downward, moving the plunger 104 and valve 108 to the left in FIG. 1 permitting air pressure to pass through the port 110 into the area 30 of the vessel 12 forcing piston 20 and rod 22 upward. A release of the trigger 72 will permit the air pressure to seat the valve 108 and the spring 96 will return the trigger to the disengaged position. At this time (see FIG. 1) air in the area 30 of vessel 12 can pass around valve 108 and be exhausted through port 112.

It should also be noted that the entire control valve 66 is positioned up under the flange area 114 of the lower housing 10 which enables the entire tool to be set on a flat surface when not in use.

In the repeated operation of the trigger and valve mechanism, wear may occur in the various parts causing a loss of desired tolerance between the various operation parts (called tolerance stack-up). Since the shoe 100 is threaded into the lower trigger rod 84, turning the hex-head 94 on the lower trigger rod will adjust the length of the trigger rod to eliminate any slack in the trigger linkage. This will assure a consistent movement of plunger 104 for proper operation of the valve 108.

Attention is now directed to FIG. 1 which illustrates the mandrel collection system 116. An adapter 118 is mounted on the rear of the tool and a collection canister 119 is detachably connected to the adapter 116. A secondary air line 120 is attached to air line 68 and passes under flange 114 up through the tool (see FIG. 1) and into a transducer 122 in the adapter 118. This creates a vacuum in the adapter and canister to draw the spent mandrel through the passageway 124 in the rivet setting mechanism and into the canister. The vacuum in the rivet setting mechanism also assists in assembling the rivet mandrel into the nosepiece 38 since the vacuum tends to hold the mandrel into the nosepiece. Further, since the secondary air line 120 is enclosed within the body of the tool and by passing into the adapter, the entire assembly is enclosed and free from any interferences with the operation of the tool. As the spent mandrels are collected, the canister 119 merely has to be removed and emptied. This can be accomplished without any interference with the vacuum creating mechanism carried on the tool.

In certain uses of a power operated tool, it may be desirable to eliminate the mandrel collection system and operate the tool with the canister 119 removed. In this situation, it is desirable to shut off the secondary air line so that the spent mandrel will not be drawn through the tool which would cause a discomfort to the operator.

Figure 2:
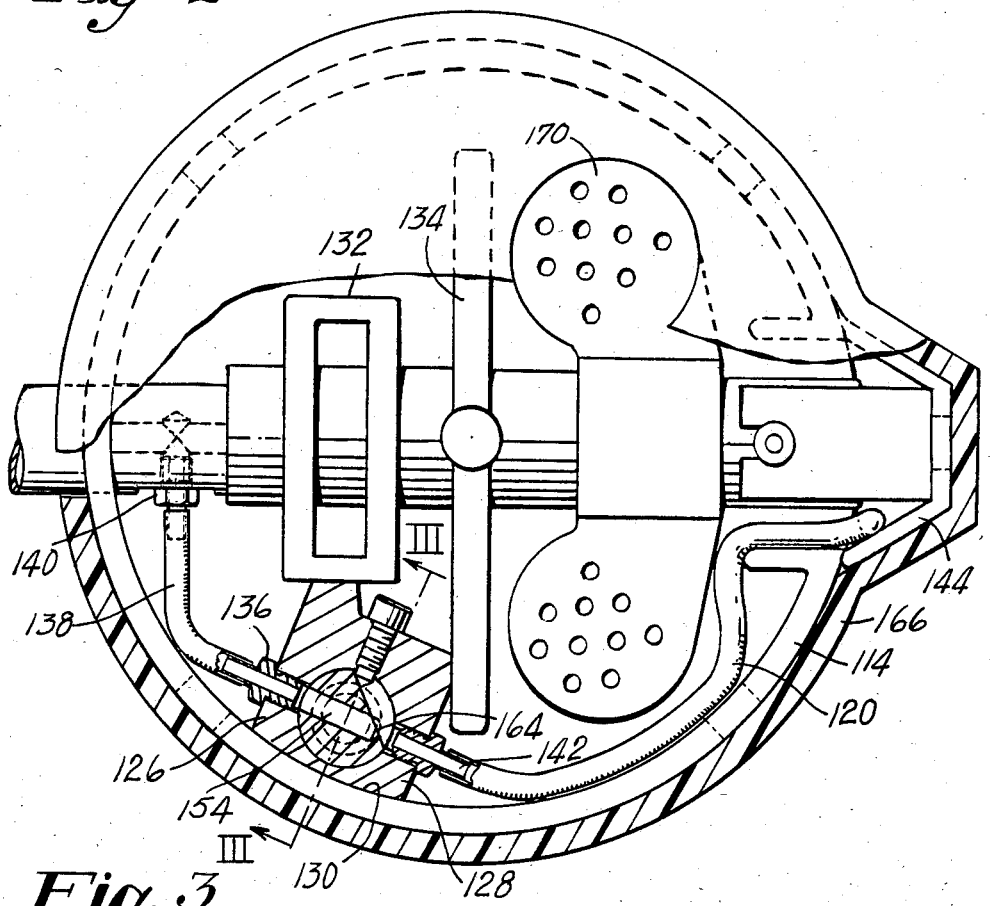
FIG. 2 is a bottom plan view of the tool illustrating the location of the control valve for the air supply to the mandrel collection system.
Figure 3:
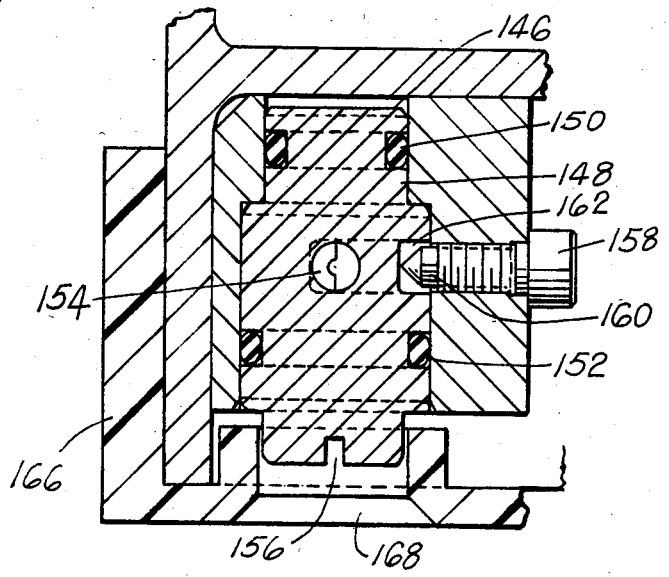
FIG. 3 is a sectional view taken along lines 3—3 of FIG. 2 illustrating the control valve.

Attention is now directed to FIGS. 2 and 3 which illustrate a control valve 126 mounted in the secondary air line 120 beneath the flange 114 on the pressure vessel 12. The control valve housing 128 is held between the inside surface 130 of flange 114 and the support flange 132 for the control valve 66 and the centrally located flange 134. The support flange 132 and central flange 134 extend to the planar surface of flange 114 to provide additional support area for the tool to set upright on a work surface.

An input coupling 136 on valve housing 128 is connected to hose 138 attached to coupling 140 on the main air line 68. An onput coupling 142 is attached to the air line 120 going to the mandrel collection system 116. Note that the air line 120 is beneath the flange 114 and passes up through the front trigger rod cover 144 so that the air line 120 is incorporated in the tool.

The valve housing 128 has an opening 146 in which a rotary spool valve 148 is sealed by O-ring seals 150, 152. The valve 148 has a through opening 154 which in the position illustrated in FIG. 2 permits the air to pass through the valve into line 120. The spool valve 148 has a slotted opening 156 accessible from the underside of the vessel so that the valve can be rotated by a screwdriver or coin. A stop pin 158 is threaded into the valve housing 128 and has a tip 160 acting against the slotted opening 162 in side of the valve. From the valve "on" position illustrated in FIG. 2, rotation of the valve 148 in a counterclockwise direction until the side 164 of the slotted opening 162 strikes stop pin 158 will place the valve in the off position rendering the mandrel collection system inoperative. It should also be noted that stop pin 158 with tip 160 not only controls the radial positioning (on/off) of valve 148, but also retains valve 148 in housing 128.

The entire flange 114 and bottom of the vessel 12 is covered by a flat boot 166 that extends upwardly around the flange 114 (see FIGS. 2 and 3). The boot 166 is provided with an opening 168 permitting access to slotted opening 156 so that the valve can be turned "on" and "off". Attention is also directed to FIG. 2 which illustrates a muffler 170 around exhaust ports 112 to slow down and muffle the air exhausted from the pressure vessel 12.

It can thus be seen that a power operated blind rivet setting tool has been provided which has a mandrel collection system controlled by a valve positioned within the flange on the bottom of the pressure vessel of the tool. Further, the air line for operating the mandrel collection system is located within the physical confines of the tool to provide an optimum profile for the tool for best tool usage.

I claim:

1. A power operated blind rivet tool adapted to automatically pull the mandrel of a blind rivet to upset the rivet body in a workpiece comprising:

a. an upper housing containing a rivet setting mechanism;

b. a lower housing secured to said upper housing and having a pressure vessel with a piston operably connected to said rivet setting mechanism;

c. said lower housing having a downwardly extending circumferential flange having a planar surface adapted to rest on a worksurface to permit the tool to be positioned upright on the worksurface;

d. a primary air supply line passing through said flange and a central support means, with said primary air supply line being operably connected through a valve to supply air to said piston, said central support means extending to said planar surface of said flange to provide additional support area for supporting the tool upright on a worksurface;

e. a mandrel collection system on said rivet setting mechanism to retrieve the pulled mandrels;

f. a secondary air line connected to said primary air line within the confines of said flange and passing to said mandrel collection system to operate said mandrel collection system;

g. said secondary air line being positioned within the physical confines of the tool; and h. a control valve positioned between said flange and said central support means and located within said planar surface and being operably connected in said secondary air line, i. said control valve being accessible from the underside of said pressure vessel to control air supplied to said mandrel collection system.

2. The power operated blind rivet tool of claim 1 in which said mandrel collection system comprises an adapter carried on the rear of the tool with said secondary air line passing into a transducer located in the adapter which permits the creation of a vacuum in the adapter to draw the pulled mandrel through the tool.

3. The power operated blind rivet tool of claim 2 including a removable pulled mandrel collection canister mounted on the adapter to collect the pulled mandrels.

4. The power operated blind rivet tool of claim 1 including a boot surrounding said flanged area and enclosing the bottom of said tool with said boot having an opening making said control valve accessible to open and close said secondary air line.

* * * * *